United States Patent [19]

Straus et al.

[11] Patent Number: 4,976,927

[45] Date of Patent: Dec. 11, 1990

[54] SOLVENT STORAGE FLASK

[75] Inventors: Daniel A. Straus, Morgan Hill, Calif.; John F. Babashak, Millville, N.J.

[73] Assignee: Kontes Glass Company, Vineland, N.J.

[21] Appl. No.: 325,876

[22] Filed: Mar. 20, 1989

[51] Int. Cl.[5] ..... B01L 3/08

[52] U.S. Cl. ..... 422/102; 422/101; 422/103; 435/296

[58] Field of Search ..... 422/99, 101, 102, 103; 435/287, 296

[56] References Cited

U.S. PATENT DOCUMENTS

| | | | |
|---|---|---|---|
| 730,674 | 6/1903 | Lyons | 422/102 |
| 1,365,183 | 1/1921 | Moffatt | 422/102 X |
| 2,666,545 | 1/1954 | Hopfield | 422/102 X |
| 3,490,736 | 1/1970 | Snyder | 422/103 X |
| 3,909,363 | 9/1975 | Bucalo | 435/287 X |
| 4,363,639 | 12/1982 | Gladen | 422/101 X |

OTHER PUBLICATIONS

Wing, H. J., "A Vacuum Distillation Flask", *The Chemist Analyst*, vol. 27, No. 2, p. 42, May 1938.

*Primary Examiner*—Robert J. Warden
*Assistant Examiner*—Lynn M. Kummert
*Attorney, Agent, or Firm*—James & Franklin

[57] ABSTRACT

The spherical containment reservoir has first and second circumferentially spaced tubular necks. A tubular bridge interconnects the first and second necks at points spaced from the reservoir. The first neck is sealed between the connecting point and the reservoir. A valve seat is situated in the second neck between the connecting point and the reservoir. The internal surface of the second neck is threaded to accept a valve stem above the valve seat.

24 Claims, 3 Drawing Sheets

SOLVENT STORAGE FLASK

The present invention relates to laboratory apparatus and more particularly to a storage flask for dry, deoxygenated and grease free solvents.

In the laboratory it is often necessary to provide for the storage and delivery of purified solvents or solutions of air sensitive reagents. It is preferable that the storage appartus be capable of forming a portion of a solvent purification system. It is further preferable that the storage apparatus be capable of being filled directly from a conventional solvent still.

The present invention relates to a solvent storage flask which, along with associated glassware for vacuum transfer and syringe or cannula manipulations, constitutes a complete system for purification, long-term storage and convenient dispensing of large (up to one liter) or small volumes of dry, deoxygenated and grease free solvents. The integrity of the atmosphere in the closed solvent storage flask is maintained by a precision PTFE to glass seal of a high vacuum valve. The flask may be conveniently filled either from a solvent still or by a vacuum transfer using a low temperature bath. In addition to solvent storage, the flasks are usable for long-term storage of Grignard and Alkyllithium reagents which often decompose when stored for several weeks or months in bottles with serum caps.

It is, therefore, a prime object of the present invention to provide a solvent storage flask usable as a part of a system for purification long-term storage and dispensing of solvents and reagents.

It is another object of the present invention to provide a solvent storage flask which may be conveniently filled either from a solvent still or by vacuum transfer using a low temperature bath.

It is another object of the present invention to provide a solvent storage flask which is useful for long-term storage of Grignard and Alkyllithium reagents.

It is another object of the present invention to provide a solvent storage flask which has increased strength and durability.

It is another object of the present invention to provide a solvent storage flask which has a narrow entry point enhancing sealability but which provides access to the interior of the flask using a cannula or long needle.

In accordance with one aspect of the present invention, a solvent strorage flask is provided including a reservoir and first and second spaced reservoir access means. Means operably connect the first and second access means at points therealong spaced from the reservoir. Means are provided to seal the first access means between the connecting point and the reservoir. Valve seat means are provided in the second access means between the connecting point and the reservoir. Means are also provided in the second access means above the valve seat means for receiving valve stem means.

Preferably, the reservoir is substantially spherical. The first reservoir access means includes a first substantially tubular neck. Preferably the axis of the first neck substantially intersects the center of the spherical reservoir.

The second reservoir access means includes a second substantially tubular neck. The first and second necks are circumferentially spaced along the surface of the reservoir.

The connecting means includes a substantially tubular bridge. The sealing means comprises an obstruction in the first neck. Preferably, the obstruction is a sealing ring.

The valve seat means includes a constriction in the second reservoir access means. The valve stem means receiving means comprises an internally threaded surface in the second reservoir access means.

The flask is intended for use with valve stem means of a type comprising an externally threaded surface. The externally threaded surface is adapted to engage the internally threaded surface of the second reservoir access means.

In accordance with another aspect of the present invention, a solvent stored flask is provided. The flask includes a fluid reservoir. First tubular neck means is provided having an open mouth. Second tubular means is provided having an open mouth. The first and second neck means are spaced along the surface of the reservoir. Tubular means for forming a fluid connection are provided between a portion of the first neck means spaced from reservoir and a portion of the second neck means spaced from the reservoir. Means are provided for sealing the first neck means at a point therealong between the connected portion and the reservoir. Valve seat means are situated in the second neck means between the connected portion and the reservoir. Means, in the second neck means, above the valve seat means, are adapted to receive valve stem means.

To these and such other objects which may hereinafter appear, the present invention relates to a solvent storage flask as described in the following specification and recited in the annexed claims, taken together with the accompanying drawings wherein like numerals refer to like parts and in which:

Figure 1:
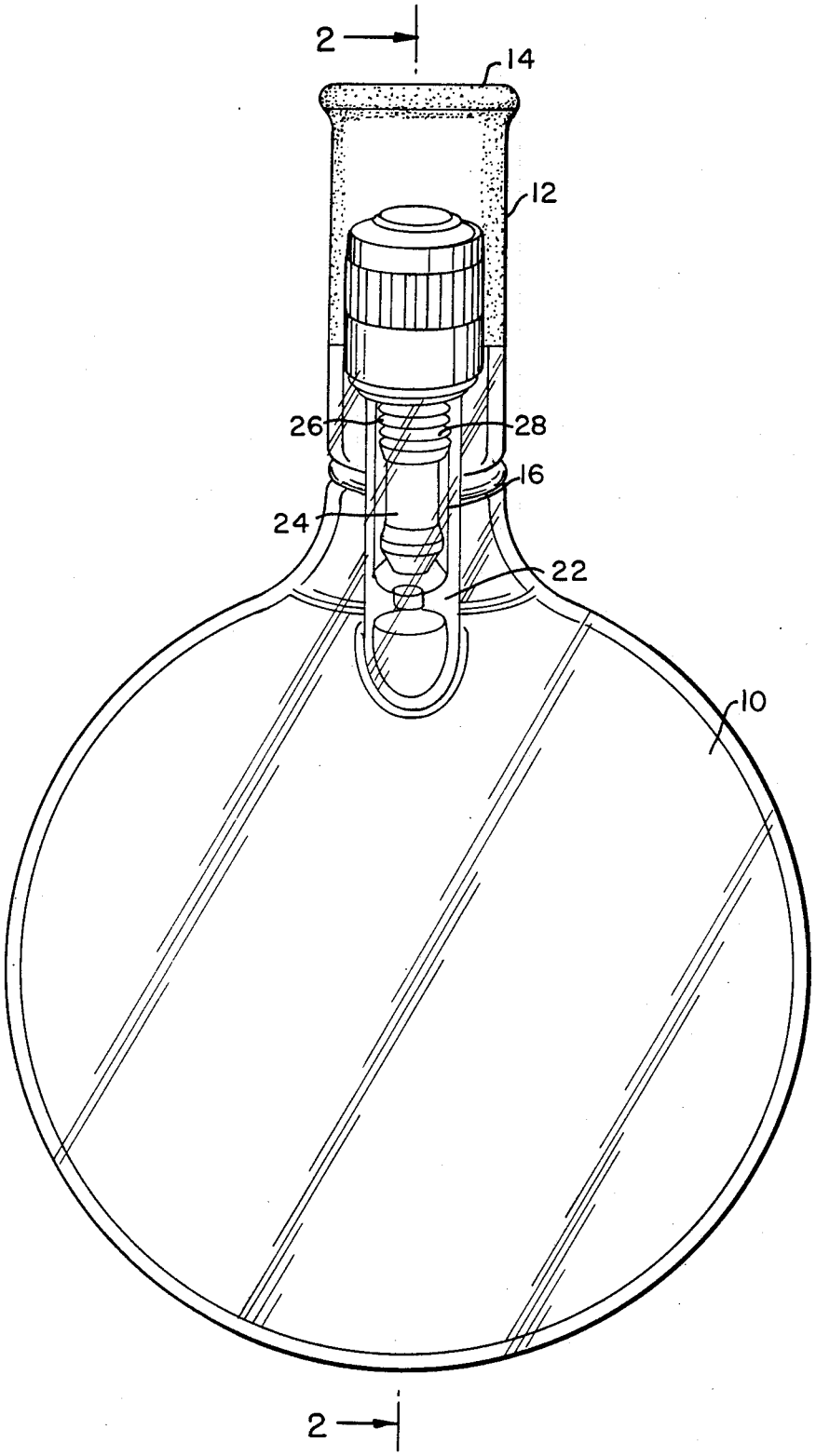
FIG. 1 is a plan view of the flask of the present invention from one side thereof.

As shown in the drawings, the flask of the present invention comprises a generally spherical glass containment chamber or reservoir 10, preferably of 500 or 1,000 mililiter capacity. Extending upwardly along an axis running through the center of reservoir 10 is a first tubular neck portion 12 with an open mouth 14. Circumferentially spaced along the surface of reservoir 10 from neck 12 is a second smalller tubular neck 16. The axis of neck 16 is preferably offset from the center of reservoir 10.

Figure 2:
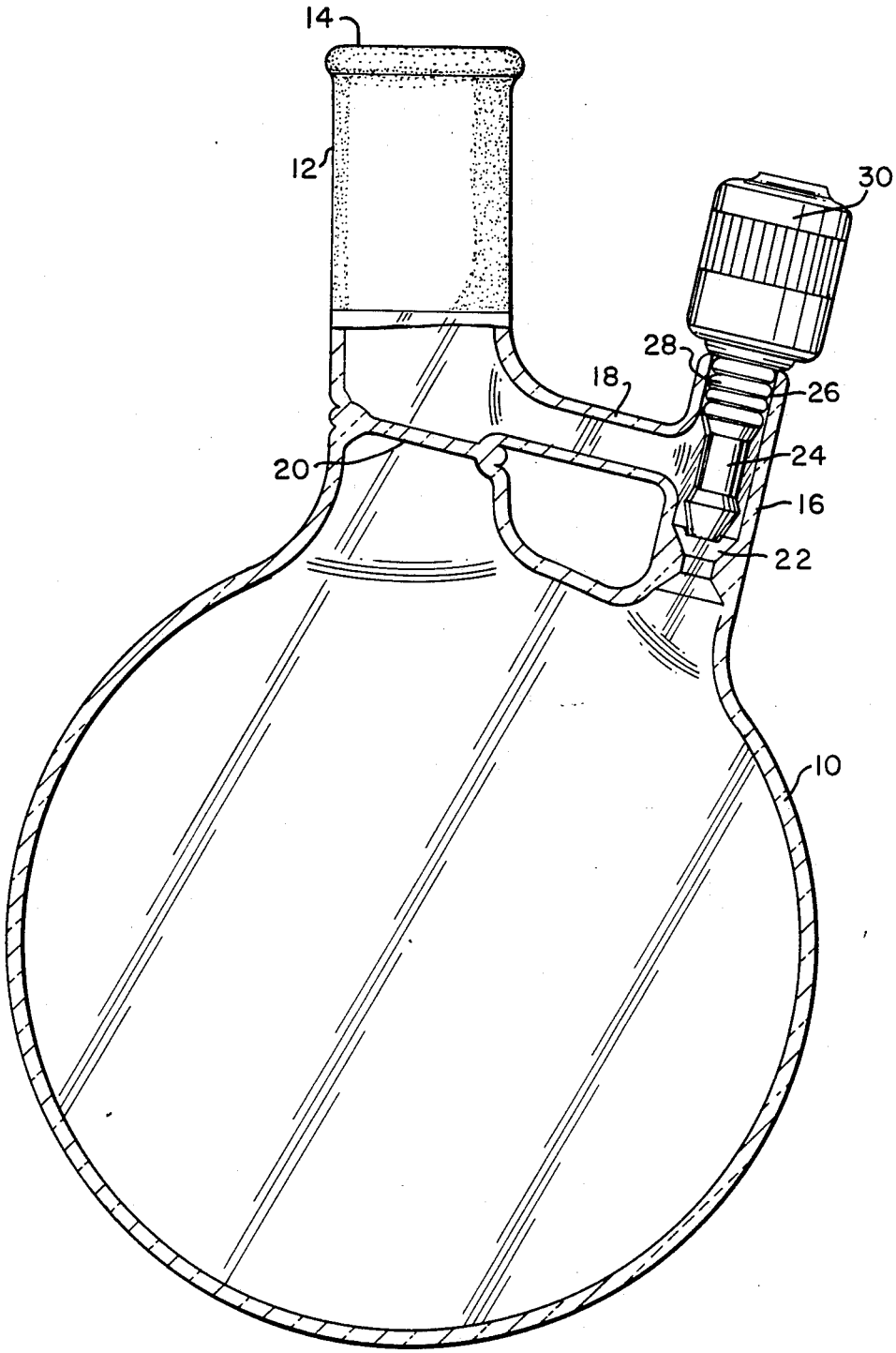
FIG. 2 is a cross sectional view taken along line 2—2 of FIG. 1.
Figure 3:
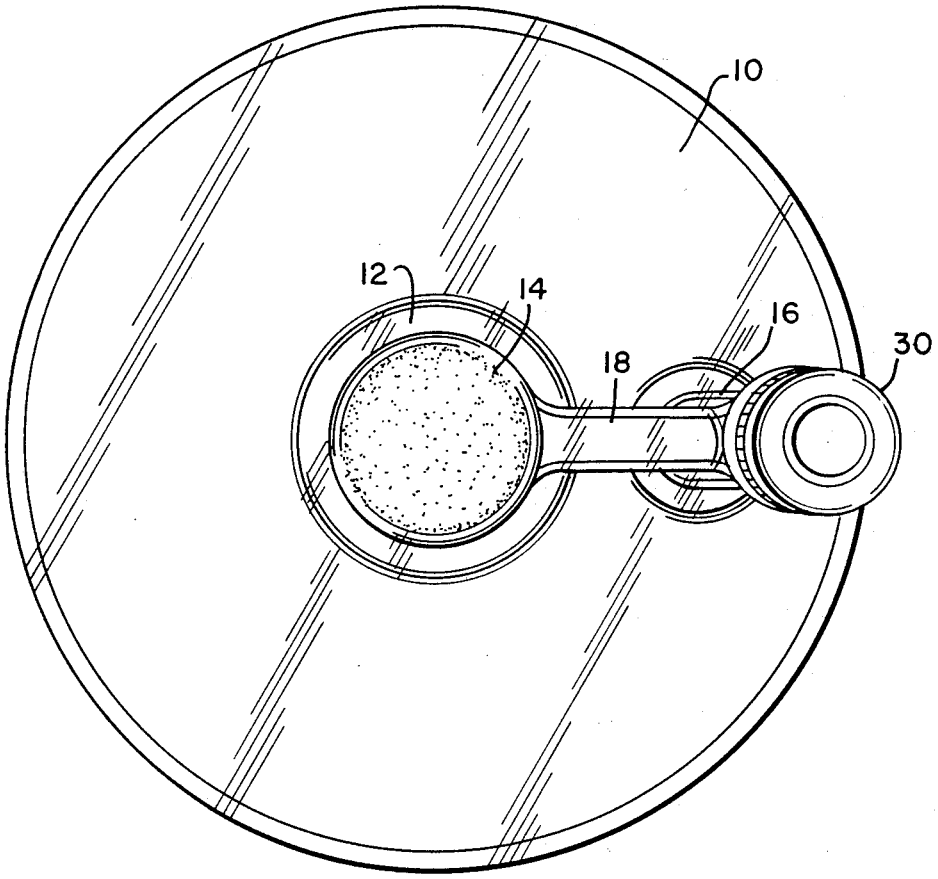
FIG. 3 is a top plan view of the flask of the present invention.

Joining necks 12 and 16 is a tubular bridge member 18 which permits fluid transfer therebetween. As best seen in FIG. 2, a ring seal 20 is formed within neck 12 between the point in neck 12 where bridge member 18 is connected and the reservoir 10. Neck 12 is completely sealed off from the interior of reservoir 10 by seal 20. The only access to the interior of reservoir 10 is through neck 16.

Within neck 16, below the portion thereof which connects with bridge member 18, is a constricted portion 22 which is designed to serve as a valve seat coat. In particular, constricted portion 22 has a substantially conical shaped above the constriction such that it can be used with a valve stem 24 having a similarly shaped tip.

The internal surface of neck 16 above valve seat 22 is provided with internal threading 26. Internal threading 26 serves as a means for sealingly receiving a valve stem 24 of conventional design having an externally threaded surface 28 and a rotatable knob 30 which serves to axially displace valve stem 24 when rotated. Preferably, the valve stem comprises a greasefree 4 mm bore 90° PTFE (TEFLON) valve. It will now be appreciated that the valve stem, when present, controls the only access to reservoir 10. However, valve stem 24 can be easily removed to permit direct access to the reservoir through neck 16 by syringe or cannula.

The flask can be used for dispensing solvent or solutions of air sensitive reagents. The flask is securely clamped in position such as about the upper portion of neck 12. Neck 12 is then fitted with a hose adapter connected to a vacuum manifold. The volume above the valve is evacuated and then placed under a positive pressure of an inert gas, such as nitrogen or argon. With a reas%nably brisk flow of nitrogen, stem 24 is completely removed from the valve seat. Under nitrogen counterflow, the threaded aperture or neck 16 is fitted with a rubber septum. The large diameter portion of the septum is folded down and the compressed septum is then slowly (to sweep off air) fitted over the glass threads 26 which hold it securely in place. The solvent (or reagent) is withdrawn via syringe or cannula and the septum is replaced with the valve stem under counterflow for further storage.

The flask can also be used in a system of the purification solvents by connecting mouth 14 of neck 12 to a vacuum manifold which permits the vacuum transfer of solvent from a solvent pot fitted with a vacuum valve adapter, at room temperature directly into an evacuated solvent storage flask cooled to low temperature with liquid nitrogen or dry ice/acetone. Use of this technique obviates the need for use of solvent stills which consume valuable lab space and may pose a fire hazard.

The solvent pot fitted with a vacuum valve adapter is charged with a drying and/or oxygen removing agent from which the purified solvent is transferred. The flask is then outgassed by stirring under vacuum for several minutes. Then the vacuum adapter valve is closed and the flask contents are stirred. After stirring, the solvent pot, still under vacuum, is fitted to the transfer manifold which is connected to neck 12 of the flask and a vacuum source. The vacuum is connected to the flask through the manifold, without the cold bath in place. The flask may be warmed with the heat gun during evacuation to insure dryness.

Once the manifold and storage flask are pumped dowm, the vacuum adapter should be opened slowly and a small volume of solvent pumped off to insure that the vacuum in the pot is still good. The vacuum is then closed off from the manifold and a cold bath is placed around the storage flask. The flask should not be allowed to become too cold and hence ruin the integrity of the vacuum seal. The valve on the flask is left fully open and the valve on the pot is adjusted to give reasonably good transfer rate without splattering into the manifold. After the transfer is complete, the cold bath is removed and the valves on the flask and pot are securely closed. After the vacuum is broken, the flask and the solvent pot are removed from the manifold.

The flask of the present invention can be used to store air sensitive agents indefinitely. In order to transfer such reagents from serum capped bottles to the storage flask, a cannula is utilized. First the solvent flask is evacuated and filled with nitrogen. The valve stem is removed and the mouth of neck 16 is fitted with a septum. A hose fitted with a needle is flushed with nitrogen and inserted in neck 16. A cannula is run between the source vessel and the flask. A vent needle is inserted into the storage flask septum. The storage flask hose is then closed to the nitrogen source and the reagent is transferred as nitrogen is forced into the source vessel.

It will now be appreciated that the present invention relates to a solvent storage flask of novel design which includes first and second circumferentially spaced necks having a connecting bridge therebetween. The first neck is sealed between the reservoir and the connection such that the only access to the reservoir is through the constricted portion of the second neck. The second neck is fitted with a removable valve stem which controls access to the reservoir through the second neck. The solvent storage flask can be used for a variety of applications, including the solvent purification, long-term storage and dispensing of dry, deoxygenated and grease-free solvents and air sensitive reagents.

While only a single preferred embodiment of the present invention has been disclosed for purposes of illustration, it is obvious many variations and modifications could be made thereto. It is intended to cover all of these variations and modifications which come within the scope of the present invention as defined by the following claims:

We claim:

1. A solvent storage flask comprising a fluid reservoir, first tubular neck means having an open mouth, second tubular neck means having an open mouth, said first and second neck means being spaced along the surface of said reservoir, tubular means forming a fluid connection between a portion of said first neck means spaced from said reservoir and a portion of said second neck means spaced from said reservoir, means for sealing said first neck means at a point between said connected portion and said reservoir, valve seat means situated in said second neck means between said connected portion of said reservoir and means in said second neck means, above said valve seat means, for receiving valve stem means, said sealing means comprising a permanent obstruction in said first neck means.

2. The flask of claim 1 where said reservoir is substantially spherical.

3. The flask of claim 2 where said first and second neck means are circumferentially spaced along said surface.

4. The flask of claim 1 where said obstruction is a sealing ring.

5. The flask of claim 1 where said valve seat means comprises a constriction in said second neck means.

6. The flask of claim 1 wherein said valve stem means receiving means comprises an internally threaded surface in said second neck means.

7. The flask of claim 6 further comprising valve stem means.

8. The flask of claim 7 wherein said valve stem means comprises an externally threaded surface means for engage said internally threaded surface.

9. The flask of claim 1 further comprising valve stem means.

10. The flask of claim 9 where said valve stem means comprises a tetrofluoroethylene valve.

11. A solvent storage flask comprising a reservoir, first and second spaced reservoir access means, means for operably connecting said first and second access means at points thereon spaced from said reservoir, means for sealing said first access means between said connecting point and said reservoir, valve seat means in said second access means between said connecting point and said reservoir, and means in said second access means above said valve seat means for receiving valve stem means, said first reservoir access means comprising a first substantially tubular neck and said sealing means comprising a permanent obstruction in said first tubular neck.

12. The flask of claim 11 where said reservoir is substantially spherical.

13. The flask of claim 12 where said first reservoir access means comprises a first substantially tubular neck.

14. The flask of claim 13 where the axis of said first neck substantially intersects the center of said spherical reservoir.

15. The flask of claim 11 where said second reservoir access means comprises a second substantially tubular neck.

16. The flask of claim 15 where said first and second necks are spaced along the surface of said reservoir.

17. The flask of claim 11 where said connecting means comprises a substantially tubular bridge.

18. The flask of claim 11 where said obstruction is a sealing ring.

19. The flask of claim 11 where said valve seat means comprises a constriction in said second reservoir access means.

20. The flask of claim 11 wherein said valve stem means receiving means comprises an internally threaded surface in said second reservoir access means.

21. The flask of claim 20 further comprising valve stem means.

22. The flask of claim 21 wherein said valve stem means comprises an externally threaded surface means for engaging said internally threaded surface.

23. The flask of claim 11 further comprising valve stem means.

24. The flask of claim 23 where said valve stem means comprises a tetrafluroethylene valve.

* * * * *